US005568161A

United States Patent [19]

Fulmer, Sr.

[11] Patent Number: 5,568,161

[45] Date of Patent: Oct. 22, 1996

[54] SECTIONALIZED ANTENNA

[75] Inventor: Leon F. Fulmer, Sr., Prosperity, S.C.

[73] Assignee: Glassmaster Company, Newberry, S.C.

[21] Appl. No.: 286,537

[22] Filed: Aug. 5, 1994

[51] Int. Cl.[6] ..... H01Q 21/00

[52] U.S. Cl. ..... 343/816; 343/801; 343/810

[58] Field of Search ..... 343/816, 810, 343/813, 820, 749, 719, 790, 791, 801; H01Q 21/00

[56] References Cited

U.S. PATENT DOCUMENTS

| | | | |
|---|---|---|---|
| 1,967,881 | 7/1934 | Green | 250/33 |
| 2,163,743 | 6/1939 | Berndt | 250/33 |
| 2,259,628 | 10/1941 | Fener et al. | 343/820 |
| 2,485,457 | 10/1949 | Potter | 250/33 |
| 2,750,589 | 6/1956 | Harris | 343/827 |
| 3,031,668 | 4/1962 | Bryson | 343/790 |
| 3,742,509 | 6/1973 | DeBettencourt et al. | 343/719 |
| 4,031,537 | 6/1977 | Alford | 343/801 |
| 4,872,021 | 10/1989 | Tabakov et al. | 343/801 |

*Primary Examiner*—Donald T. Hajec
*Assistant Examiner*—Hoanganh Le
*Attorney, Agent, or Firm*—Rhodes, Coats & Bennett L.L.P.

[57] ABSTRACT

A sectionalized electromagnetic antenna formed of a plurality of co-linear stacked dipole sections. Each of the sections includes a plurality of co-linear conductor elements for conducting an electrical current. A phasing section is disposed between the conductor elements to shift the phase of current through the adjacent conductor element. A connector fitting is located at each end of each of the sections for detachably mechanically and electrically connecting one of the sections to another of the sections. Sections may be added or removed from an antenna of the present invention to obtain a desired gain, radiation pattern or overall length.

12 Claims, 2 Drawing Sheets

SECTIONALIZED ANTENNA

FIELD OF THE INVENTION

The present invention is directed to antennas, and more particularly, to a sectionalized, co-linear stacked dipole antenna.

BACKGROUND OF THE INVENTION

Antennas comprising co-linearly arranged half-wave dipoles are widely used for reception and transmission of electromagnetic energy. Such antennas are commonly used in a variety of applications including marine communications. The typical use of the antenna involves the radiation or reception of a signal of sinusoidally varying electromagnetic waves, which travel at the speed of light with a particular frequency and wavelength. The wavelength of the signal determines the most desirable length for an antenna, as is very well-known in the art. As used herein, the term "wavelength" means the wavelength of an intended signal and "half-wave" and "quarter-wave" mean the length of one-half and one-quarter of a wavelength, respectively.

Typically, co-linear stacked dipole antennas comprise one or more sections which house two or more half-wave dipoles or conductor elements which are stacked vertically end to end to form the resulting antenna which may be considerably longer than the wave length employed. The length of each element and the number of elements may be selected to achieve a desired radiation pattern and gain. Generally, each section includes a support tube and a length of conventional coaxial cable which has a center conductor and a braided outer conductor, the two conductors being electrically insulated from one another. The coaxial cables of adjacent elements are cross-fed. That is, the center conductor of a first element is electrically connected with the braided outer conductor of a second element; the braided outer conductor of the second element is electrically connected with the center conductor of a third element, and so forth. Thus, the phase of the current through each element is in phase with that of the next element, creating the desired current phasing.

The antenna design described above has several significant drawbacks, especially in marine and other transportation-related applications. Oftentimes, it is necessary for an antenna of this nature to be relatively long in order to achieve a desired gain. In marine applications, an antenna may be as long as 25 feet. While this length may be acceptable on open waters, it may be inconvenient or dangerous to have an antenna of this size mounted when a boat is passing under a bridge or navigating congested waters. Furthermore, it is desirable to be able to stow the antenna when the boat is in storage or in transit over land. Antennas having cross-fed coaxial cables have been designed to provide for "break-down" or dismounting and folding of the antenna. Notably, the elements of such an antenna cannot be separated without severing the connections between the coaxial transmission lines which in turn destroys the electrical characteristics of each line. To provide for some degree of break-down, antennas of this type have been designed with support tubes having slip joint connections, allowing the support tubes to be separated and folded alongside one another (still interconnected by the transmission line). Breaking the antenna down in this manner leaves the coaxial cable exposed and the antenna in still relatively difficult to handle.

A second drawback of conventional co-linear stacked antennas is that they have limited adaptability. In some situations, it is desirable to extend or reduce the length of the antenna to increase its gain or reduce its size, respectively. The length of conventional antennas of this type is generally not modifiable.

SUMMARY OF THE INVENTION

The present invention is directed to a co-linear vertically stacked half-wave dipole antenna which may be dismantled and be reassembled to have a desired length. The antenna of the present invention includes a plurality of modular dipoles or sections stacked vertically end to end. Each section includes (1) one or more single conductor elements each having a length of one-half or one-fourth of a wavelength; and one or more current phasing sections for reversing the phase of the current through the elements to achieve desired gain and radiation pattern shaping. A mechanical/electrical fitting on each end mechanically connects one section to adjacent sections and electrically connects their respective elements. Sections may be separated and rejoined without destroying the electrical properties of the connections. Furthermore, sections, and thus elements, may be added or removed from an antenna constructed according to the present invention to obtain a desired gain or overall length.

It is an object of the present invention to provide a sectionalized electromagnetic antenna.

Another object of the present invention is to provide a sectionalized, electromagnetic, co-linear, stacked dipole antenna which utilizes single conductor half-wave and one-fourth wave elements.

Another object of the present invention is to provide a sectionalized antenna as described above which can be conveniently dismantled by separating the elements and which can be reconstructed by rejoining the elements.

Yet another object of the present invention is to provide a sectionalized antenna as described above which may be selectively and conveniently constructed to a multiplicity of lengths to obtain desired gain, radiation pattern, and overall length.

DETAILED DESCRIPTION OF THE PREFERRED EMBODIMENT

Figure 1:
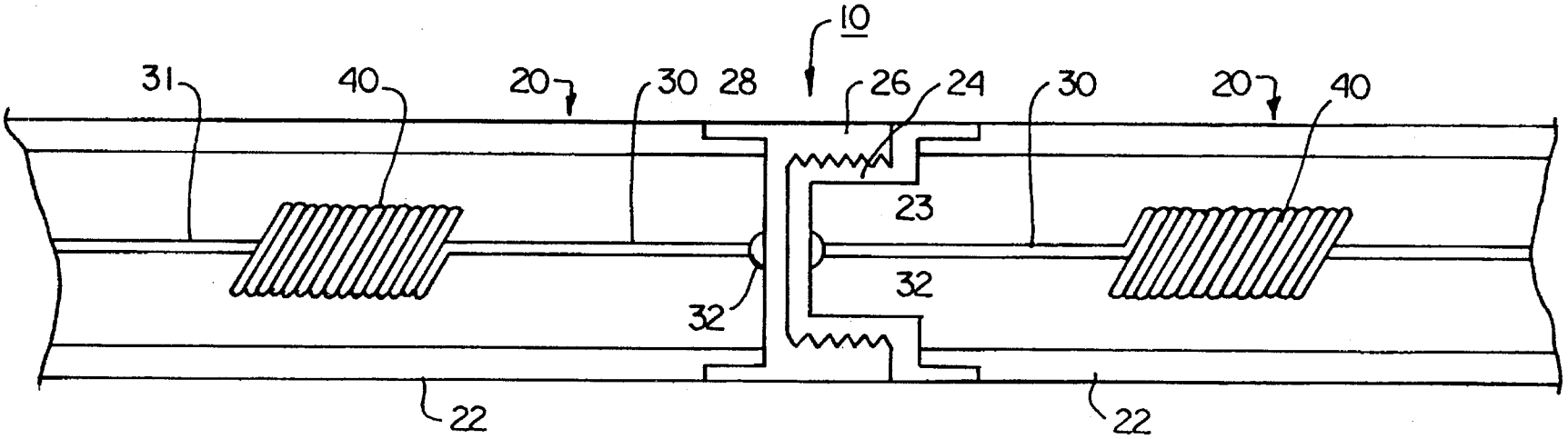
FIG. 1 is a partial cross-sectional view of a portion of an embodiment of the present invention.
Figure 2:
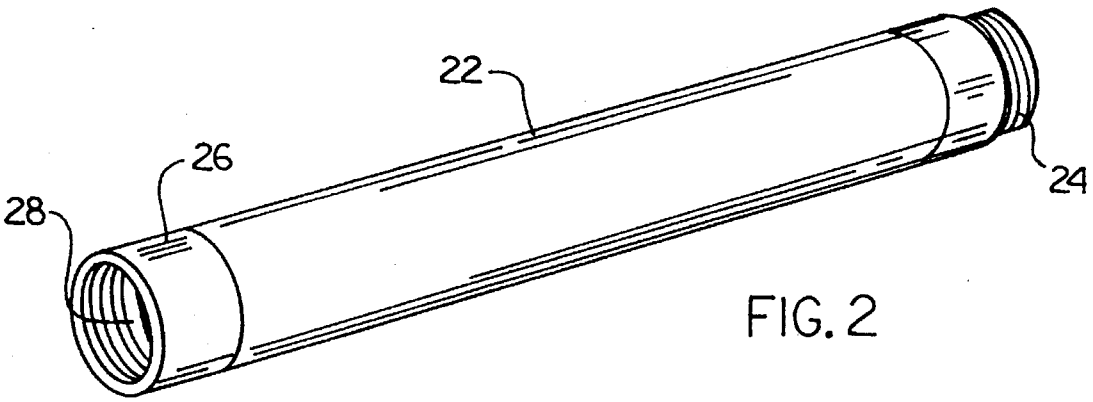
FIG. 2 is a perspective view of a dipole element used in the embodiment of FIG. 1.

In the following description, like reference characters designate like or corresponding parts throughout several views. Referring now to the drawings in general, it will be understood that the illustrations are for the purpose of describing a preferred embodiment of the invention and are not intended to limit the invention thereto.

Figure 6:
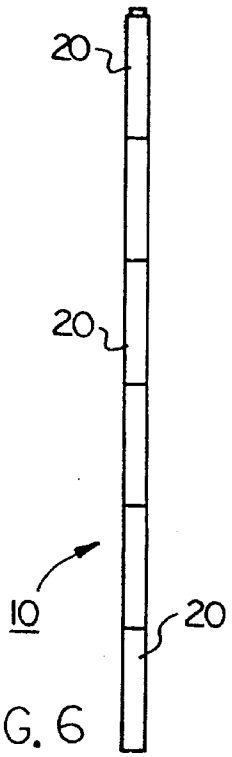
FIG. 6 is a side elevational view of an antenna of the present invention wherein the radiation pattern emitted from the antenna is shown schematically.

As best seen in FIG. 1, the sectionalized antenna 10 of the present invention includes dipole sections or modules 20. Sections 20 further include rigid support tubes 22 which surround single conductor elements 30,31 and phasing sections 40. Support tubes 22 may be formed from any suitable material and, preferably, are formed from fiberglass using conventional fiberglass fabrication techniques. Each section 20 has a threaded male fitting 24 formed at one end and a threaded female fitting 26 formed at its other end. The fittings are constructed from a rigid, electrically conductive material, preferably brass, and are secured to the ends of support tubes 22 in any suitable manner. Sections 20 may be connected and stacked to form a vertical antenna as shown in FIG. 6.

Referring to the connectors of sections 20 now in more detail, FIG. 1 shows two sections 20 joined. Male fitting 24 has screw threads formed about its outer circumference. Female fitting 26 has screw threads formed about its inner circumference arranged and configured to receive and secure the threads of male fitting 24. Male and female fittings 24,26 have end walls 23 and 28, respectively. The ends of elements 30,31 are preferably secured to end walls 23,28 by solder 32. Other electrical connections can be used, as long as there is a conductive path from the elements 30,31 to the end walls. It will be appreciated that when electrically conductive fittings 24,26 are mechanically connected, they will electrically connect the elements 30,31 of adjacent, interconnected sections.

Elements 30,31 may be formed from any suitable material and in the preferred embodiment are constructed from brass or copper. Phasing sections 40 may be any suitable devices for shifting the phase of the current through elements 30. In the preferred embodiment, phasing sections 40 are coils formed of helical windings having turns selected to be capable of shifting the current phase of an alternating current signal in adjacent elements 30,31 by 180 electrical degrees.

Sections 20 may be constructed as follows. Elements 30,31 are soldered to phasing section(s) 40 and/or feed point 42. Elements 30,31, joined by phasing section(s) 40 and/or feed point 42, as discussed hereinafter, are connected to a fitting 24 or 26 by soldering the appropriate free end of the elements to the fitting. The elements, phasing section(s) and/or feed point are then inserted into a support tube 22, whereupon the attached fitting is bonded to the support tube. Solder is then placed on the remaining free end of the elements or on the remaining fitting. Finally, the remaining fitting is placed in contact with the element so that they are soldered together and the fitting is secured to the support tube 22.

Figure 5:
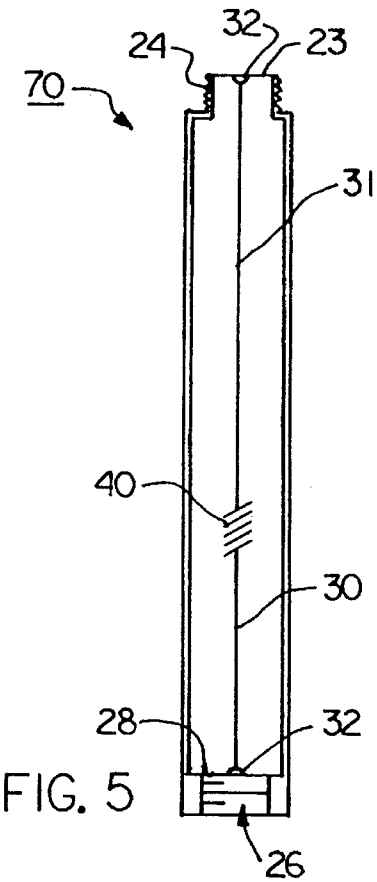
FIG. 5 is a schematic cross-sectional view of a top section of an antenna according to the invention.
Figure 4:
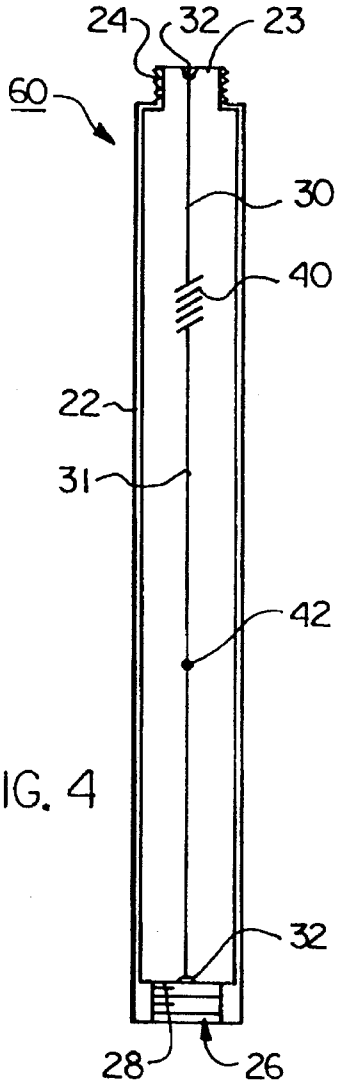
FIG. 4 is a schematic cross-sectional view of a bottom section of an antenna according to the invention.
Figure 3:
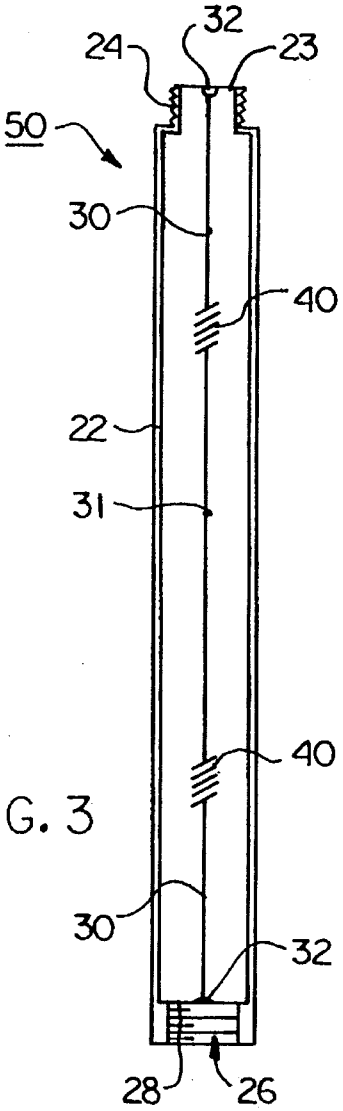
FIG. 3 is a schematic cross-sectional view of an intermediate section of an antenna according to the invention.

In the preferred embodiment, the antenna 10 of the present invention includes three types of dipole sections: 1) one or more intermediate sections 50 (FIG. 3); 2) a bottom section 60 (FIG. 4); and 3) a top section 70 (FIG. 5). All three types of sections are constructed basically as described above for section 20.

Intermediate section 50 (FIG. 3) preferably includes at least one central element 31 having a length equal to one-half wavelength of the desired frequency (hereinafter referred to as half-wave element 31). Each half-wave element 31 has a phasing section 40 on each end thereof. Intermediate section 50 further includes two elements 30 having a length of one-fourth of the desired frequency (hereinafter quarterwave element 30). Quarter-wave elements 30 each have one end connected with a phasing section 40 and the other end soldered to an end wall 23 or 28 as described above. In an alternative preferred embodiment, intermediate section 50 includes only the two quarter-wave elements 30 joined by a single phasing section 40.

Bottom section 60 (FIG. 4) has a half-wave element 31 soldered at one end to end wall 28 and at the other end to feed point 42. A second half-wave element 31 extends from feed point 42 to a phasing section 40. A quarterwave element 30 extends from phasing section 40 and is soldered to end wall 23. Feed point 42 may be any suitable connector, such connections being well-known in the art. Additionally, feed point 42 may include an impedance matching circuit for matching the antenna impedance to the transmission line, such circuits being well known in the art.

Top section 70 (FIG. 5) includes a quarterwave element 30 soldered on one end to end wall 28 and electrically connected at its other end to a phasing section 40. A half-wave element 31 is soldered to end wall 23 at one end and is connected to the phasing section 40 at the other end.

In operation, sections 50, 60, and 70 are interconnected by securing the female fitting 26 of bottom section 50 onto an insulating supporting base (not shown) and then screwing the male fitting 24 of bottom section 60 into the female fitting 26 of an intermediate section 50. Depending on the amount of gain desired by the user, more intermediate sections 50 may be added. By breaking the half-wave elements at the connect point in relation to current and phase, additional sections can be added without changing the impedance matching characteristics. Finally, the female fitting 26 of top section 70 is screwed onto the male fitting 24 of the last intermediate section 50. For best results, end walls 23 and 28 of respective sections should be placed in complete contact with one another. The transmitter, receiver or transceiver, as the case may be, is then connected to the antenna at feed point 42.

Several aspects of the antenna 10 as assembled above are noteworthy. First, going from bottom to top, antenna 10 begins with one full wavelength of conductor elements having the same phase current thereon, this being known to be desirable in antennas of this type. Second, where intermediate sections 50 are joined with one another and with top section 70, the adjacent quarter-wave elements 30 form a length equal to a half-wave element.

Any number of half-wave elements 31 connected by phasing sections 40 may be added to any or all of sections 50, 60, and 70. Thus, additional half-wave elements 31 may be added to intermediate section 50 between quarterwave elements 30. Bottom section 60 may be configured such that the second half-wave element 31 is followed by more half-wave elements 31 interconnected by phasing sections 40, and is finally joined by a phasing section with a quarterwave element 30 which is soldered to end wall 23. Top section 70 likewise may have one or more additional half-wave elements 31 interconnected by phasing sections 40 with the last one-half wavelength element 31.

In the preferred embodiment, bottom section 60 will be from about 10 feet to about 15 feet long, intermediate sections 50 will be from about three feet to about seven feet long, and top section 70 will be from about two feet long to about six feet long. The lengths of elements 30,31 will depend on the frequency for which the antenna is designed for use. Elements 31 are substantially twice as long as elements 30, elements 31 typically ranging from about 6 inches to about 18 inches in length. Support tubes 22 will preferably have a diameter of from about 2 inches to about 0.5 inches.

While the sections of the antenna shown and described are electrically and mechanically connected by means of complimentary threaded male and female fittings 24,26, it will be appreciated that any suitable means for accomplishing the connection may be used including bayonet mounts, splices, and the like.

Certain modifications and improvements will occur to those skilled in the art upon a reading of the foregoing description. It should be understood that all such modifications and improvements have been deleted for the sake of conciseness and readability, but are properly within the scope of the following claims:

I claim:

1. A dipole section for an electromagnetic, co-linear, stacked dipole antenna, comprising:

a) a support tube having two ends;

b) a pair of connector fittings, one being located at each end of said support tube;

c) a pair of electrically conductive elements disposed end-to-end within said support tube, each of said elements having one end electrically connected with one of said connector fittings; and d) a phasing section disposed between the adjacent ends of said conductive elements and operative to shift the phase of current through said elements.

2. The dipole section of claim 1 wherein said support tube is constructed of fiberglass.

3. The dipole section of claim 2 wherein the length of one of said elements is one-half of a wavelength corresponding to a selected frequency.

4. The dipole section of claim 2 wherein the length of one of said elements is one-fourth of a wavelength corresponding to said selected frequency.

5. The dipole section of claim 2 wherein said elements are soldered to said connector fittings.

6. The dipole section of claim 2 wherein said connector fittings are arranged and configured such that they may be detachably mechanically and electrically connected with connector fittings of adjacent dipole sections.

7. The dipole section of claim 1 wherein said connector fittings are constructed from an electrically conductive material.

8. A dipole section for an electromagnetic, co-linear, stacked dipole antenna, comprising:

a) a support tube having first and second ends;

b) a first fitting mounted on said first end of said support tube;

c) a second fitting mounted on said second end of said support tube;

d) first, second and third elements disposed within said support tube and being operable to conduct electrical current;

e) a first phasing section electrically connecting said first element and said second element and a second phasing section electrically connecting said second element and said third element;

f) wherein said first element is electrically connected with said first fitting and said third element is electrically connected with said second fitting; and g) wherein said first phasing section is operative to shift the phase of current between said first and second elements and said second phasing section is operative to shift the phase of current between said second and third elements.

9. The dipole section of claim 8 wherein said support tube is formed from fiberglass.

10. The dipole section of claim 8 wherein said first and second fittings are constructed of electrically conductive material.

11. The dipole section of claim 8 wherein said first fitting is arranged and configured such that it may be detachably mechanically and electrically secured with said second fitting of an adjacent dipole section.

12. The dipole section of claim 8 wherein said first and third elements each have a length of one-fourth of a wavelength corresponding to a selected frequency and said second element has a length of one-half of a wavelength corresponding to the selected frequency.

* * * * *